US011076670B2

(12) United States Patent
Sugawara

(10) Patent No.: US 11,076,670 B2
(45) Date of Patent: Aug. 3, 2021

(54) HAIR CARE PRODUCT APPLICATOR MEMBER AND SYSTEMS AND METHODS THEREOF

(71) Applicant: Kao Corporation, Tokyo (JP)

(72) Inventor: Hirokatsu Sugawara, Cincinnati, OH (US)

(73) Assignee: Kao Corporation, Tokyo (JP)

( * ) Notice: Subject to any disclaimer, the term of this patent is extended or adjusted under 35 U.S.C. 154(b) by 547 days.

(21) Appl. No.: 15/855,473

(22) Filed: Dec. 27, 2017

(65) Prior Publication Data

US 2018/0184778 A1 Jul. 5, 2018

Related U.S. Application Data

(60) Provisional application No. 62/440,138, filed on Dec. 29, 2016.

(51) Int. Cl.

| | |
|---|---|
| ***A45D 7/02*** | (2006.01) |
| ***A45D 7/00*** | (2006.01) |
| ***A45D 19/00*** | (2006.01) |
| ***A45D 19/02*** | (2006.01) |
| ***A45D 34/04*** | (2006.01) |

(52) U.S. Cl.

CPC ..... *A45D 19/012* (2021.01); *A45D 19/02* (2013.01); *A45D 34/042* (2013.01); *A45D 19/0066* (2021.01); *A45D 2200/057* (2013.01)

(58) Field of Classification Search

CPC ..... A45D 19/0008; A45D 19/02; A45D 2019/0091; A45D 34/042; A45D 2200/057

USPC ..... 401/9–11

See application file for complete search history.

(56) References Cited

U.S. PATENT DOCUMENTS

| | | | | |
|---|---|---|---|---|
| 2007/0235053 | A1* | 10/2007 | Morgenstern | A45D 24/24 132/114 |
| 2012/0006350 | A1* | 1/2012 | Geuther | A45D 19/0008 132/270 |
| 2012/0272995 | A1* | 11/2012 | Da Silva | A46B 9/023 132/270 |
| 2013/0133678 | A1* | 5/2013 | Nakashima | A45D 19/0008 132/116 |

* cited by examiner

*Primary Examiner* — Rachel R Steitz

(74) *Attorney, Agent, or Firm* — Oblon, McClelland, Maier & Neustadt, L.L.P.

(57) ABSTRACT

Hair care product applicators and systems and methods thereof, are described herein. The hair care product applicator can have multiple platforms configured to hold, table, or confine respective portions of a group of strands of hair, where a first platform is configured to hold a first portion of the group of strands of hair, and a second platform, which can be spaced apart from the first platform, is configured to hold a second portion of the group of strands of hair. The second portion of the group of stands of hair can correspond to the entire group of stands of hair, and the first portion of the group of strands of hair can correspond to less than the entire group of strands of hair. An amount of hair care product can be discharged via a discharge opening for application to at least part of the group of stands of hair.

19 Claims, 15 Drawing Sheets

HAIR CARE PRODUCT APPLICATOR MEMBER AND SYSTEMS AND METHODS THEREOF

CROSS-REFERENCE TO RELATED APPLICATIONS

This application claims the benefit of Provisional Application No. 62/440,138, filed Dec. 29, 2016, the entire substance of which is incorporated herein by reference.

FIELD

Embodiments of the disclosed subject matter are directed generally to product applicators, and more particularly to hair care product applicators, and systems and methods thereof.

SUMMARY

According to one or more embodiments of the present disclosure, an applicator member to provide hair care product is provided. The applicator member comprises a base defining a discharge opening to discharge the hair care product; a first platform extending from the base adjacent a first side of the discharge opening, the first platform having a free end configured to hold a first amount of hair; and a second platform provided adjacent a second side of the discharge opening opposite the first side, the second platform defining a first cutout configured to hold a second amount of hair greater than the first amount of hair. A first part of the first cutout farthest from the base is wider than a second part of the first cutout closest to the base.

Also, in one or more embodiments, an applicator attachment tip for applying hair dye is provided. The applicator attachment tip comprises: a base having a first side and a second side opposite the first side and defining a discharge opening, the first side having an upper surface; a nozzle, which surrounds the discharge opening, extending from the upper surface of the base, the nozzle including a first platform extending from the upper surface of the base; and a second platform extending from the upper surface of the base, the discharge opening being between the first platform and the second platform, the second platform having a wall that defines only one cutout. The second platform is spaced from the discharge opening more than the first platform is spaced from the discharge opening. Also, a first part of the cutout farthest from the upper surface of the first side of the base is wider than a second part of the cutout closest to the upper surface of the first side of the base. Further, a height of the cutout is greater than a width of the cutout at the first part, the width of the cutout at the first part being a value from about 1.5 millimeters to about 15 millimeters or from about 2.5 millimeters to about 12 millimeters. Additionally, the second part of the cutout closest to the upper surface of the first side of the base is offset from the upper surface of the first side of the base in a direction in which the second platform extends from the upper surface of the first side of the base, and the first platform has a height, as measured from the upper surface of the base, greater than a width.

Embodiments also include methods of providing and/or using an applicator member, such as an applicator attachment tip, according to embodiments of the disclosed subject matter. For example, according to one or more embodiments of the disclosed subject matter, a method of using an applicator member for a hair care product is implemented. The method comprises providing the applicator member to apply the hair care product, the applicator member, where the applicator member includes: a base defining a discharge opening to discharge the hair care product for application, a first platform extending from the base adjacent a first side of the discharge opening, the first platform having a free end configured to hold a first amount of hair, and a second platform provided adjacent a second side of the discharge opening opposite the first side, the second platform defining a cutout configured to hold a second amount of hair greater than the first amount of hair. A first part of the cutout farthest from the base is wider than a second part of the cutout closest to the base. The method also comprises: for a group of strands of hair, providing a first part of the group of strands of hair to the second platform, in the cutout of the second platform, the first part of the group of strands of hair corresponding to the second amount of hair; and providing a second part of the group of strands of hair on the first platform, the second part of the group of strands of hair corresponding to the first amount of hair.

BRIEF DESCRIPTION OF THE DRAWINGS

The accompanying drawings, which are incorporated in and constitute a part of the specification, are illustrative of one or more embodiments of the disclosed subject matter, and, together with the description, explain various embodiments of the disclosed subject matter. Further, the accompanying drawings have not necessarily been drawn to scale, and any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figure 1:
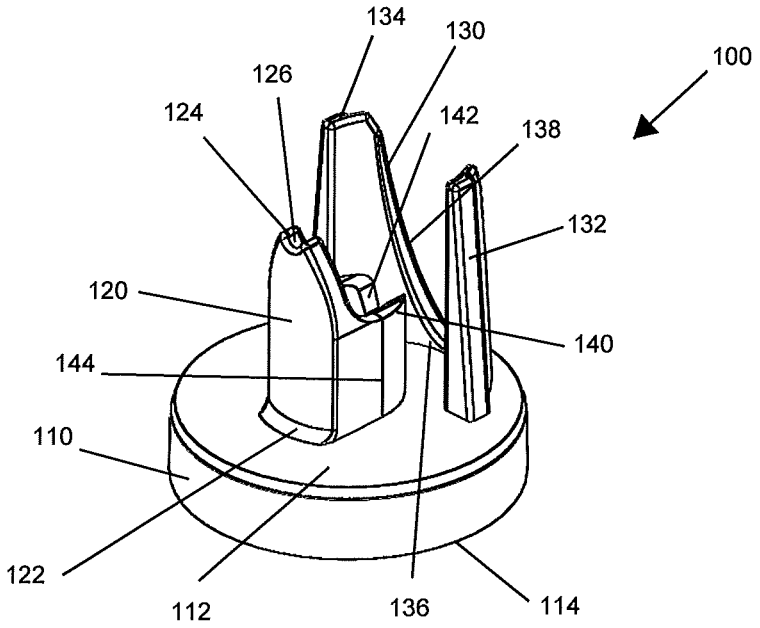
FIG. 1 is a rear right side perspective view of an applicator member to apply or dispense hair care product according to one or more embodiments of the disclosed subject matter.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

As noted above, embodiments of the disclosed subject matter are directed to product applicators, such as hair care product applicators, and systems and methods thereof. Further, in some cases, embodiments of the disclosed subject matter may be directed to a portion of a hair care product applicator, such as a hair care product applicator member. Hair care products for application by embodiments of the disclosed subject matter can be in liquid, foam, or gel form, for instance. Further, the hair care products may be for hair care, such as for hair dying (including highlights and lowlights), relaxer, etc.

Generally speaking, hair care product applicators according to embodiments of the disclosed subject matter can have multiple platforms each configured to hold, table, or confine respective portions of a group of strands of hair for application of a hair care product. More particularly, a first platform of the multiple platforms can be configured to hold a first portion of the group of strands of hair, and a second platform, which can be spaced apart from the first platform, can be configured to hold a second portion of the group of strands of hair. The second portion of the group of stands of hair, which may be more than the first portion of the group of strands of hair, can correspond to the entire group of stands of hair. An amount of the hair care product can be discharged via a discharge opening for application to the group of stands of hair. Thus, one or more embodiments of the disclosed subject matter may lead to relatively even distribution and application of a desired or proper amount of the hair care product, as perceived by the user of the hair care product applicator, for instance. Further, embodiments of the disclosed subject matter may prevent the user from developing the desire to spread the hair care product using a means other than with the hair care product applicator, such as the user's hand.

Turning now to the figures, particularly to FIGS. 1-8, these figures show various views of an applicator member 100 according to one or more embodiments of the disclosed subject matter. Applicator member 100 may be configured to provide hair care product, such as hair dye, to hair of a user or of a person subject to the care of a hair care professional using the applicator member 100. In general, the applicator member 100 can be comprised of a base 110, a first platform 120, and a second platform 130. Applicator member 100 preferably can be made of polypropylene (PP), polyethylene (PE), polyethylene terephthalate (PET), acrylonitrile butadiene styrene (ABS), or acrylic; more preferably of polypropylene (PP) or polyethylene (PE); even more preferably of polypropylene (PP).

The base 110 may define a discharge opening 111 with a first side 111*a* and a second side 111*b* opposite the first side 111*a*. Further the base 110 may include an upper surface 112 and a lower side 114 opposite the upper surface 112. As can be seen from FIGS. 5, 7, and 8, the base 110 can also include a connection interface 116, which may be comprised of an outer wall 117 and optionally an inner wall 118 depending upon the configuration of the connection interface 116.

The connection interface 116 may be configured to be coupled to another component of a hair care product application system, such as an angled interface 300 (see FIGS. 16 and 17) discussed in more detail below. The connection interface 116 may be fixedly or removably connectable or connected to another component of a hair care product application system, such as the angled interface 300. That is, the connection interface 116 may be fixed in a non-removable nature to angled interface 300, such as by adhesive, plastic welding, or formed in one piece. Alternatively, the connection interface 116 may be removably coupled to angled interface 300 via a threaded connection (i.e., threads), a snap fit connection (i.e., snap fitted components), etc. For example, applicator member 100 may be snap fitted to angled interface 300 based on the configuration of the outer wall 117 and the inner wall 118 of the connection interface 116. The snap fit of application member 100 to angled interface 300 may be such that the application member 100 can be removed from the angled interface 300 and reattached in snap fit fashion via the snap fit configuration of the outer wall 117 and the inner wall 118 of the connection interface 116.

The first platform 120 can extend from the base 110 adjacent or at the first side 111*a* of the discharge opening 111, and the first platform 120 may have a platform base 122 and a free end 124 opposite the platform base 122. Thus, in one or more embodiments, the platform base 122 of the first platform 120 may define a portion of an inner surface of the discharge opening 111.

Figure 2:
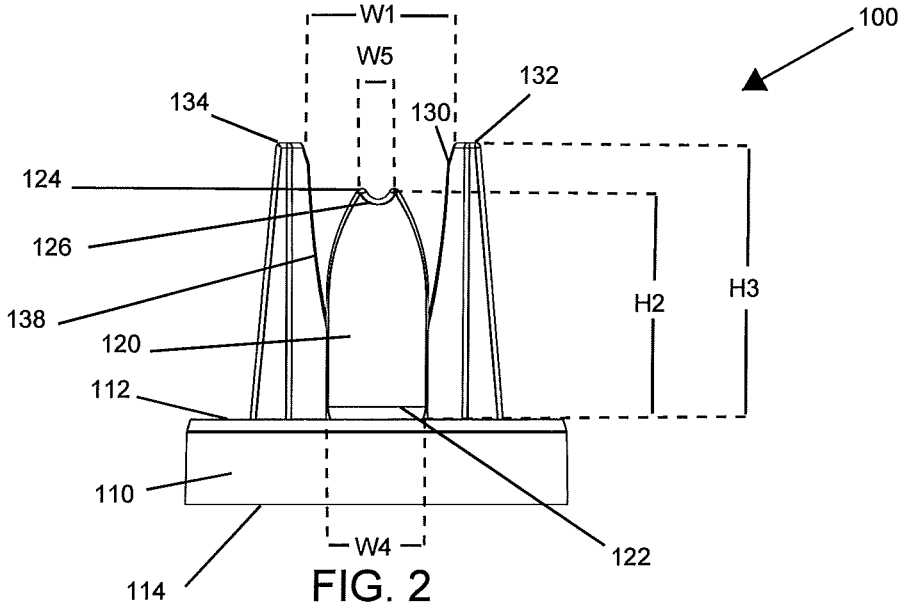
FIG. 2 is a rear elevational view of the applicator member of FIG. 1.

As illustrated in FIG. 2, for instance, the first platform 120 may have a height H2 and a width W4 at the platform base 122. The height of the first platform 120 may be greater than the width. That is, height H2 may be greater than width W4. Non-limiting examples of values for the width W4 of the first platform 120 are preferably from about 2 millimeters to about 10 millimeters, more preferably from about 3 millimeters to about 7 millimeters.

Optionally, the free end 124 may have a cutout 126. Alternatively, the free end 124 may be serrated, uneven, grooved, flat, concave, or convex. Thus, in some embodiments the first platform 120 may be configured to hold or table a first amount or portion of hair. In other embodiments the first platform 120 may additionally confine the hair. For example, the cutout 126 may hold the first amount or portion of hair and also confine such amount or portion of hair within the void of the cutout 126, which may assist the first amount or portion of hair to stay on the first platform 120. The free end 124 may also have a width W5. Optionally, the width W5 may be less than the width W4 at the platform base 122 in the side elevational view of the applicator member 100 illustrated in FIG. 2. Put another way, in the side elevational view of FIG. 2, the width W4 and the width W5 are oriented the same, i.e., perpendicular to a central vertical axis of the first platform 120, and the width W5 may be less than the width W4. Thus, in one or more embodiments, the width of the first platform 120, in a side elevational view, such as illustrated in FIG. 2, may taper from the platform base 122 to the free end 124. Alternatively, in the side elevational view, the first platform 120 may have a uniform width from the platform base 122 to the free end 124. As yet another alternative, in the side elevational view, the first platform 120 may taper from the free end 124 to the platform base 122. In another side elevational view of the first platform 120, such as FIG. 4, the first platform 120 may have at least a portion, for instance, an upper portion, formed in a bill-shape. Further, in the side elevational view of FIG. 4, for instance, the applicator member 100 may be asymmetrical.

The second platform 130 may be provided adjacent the second side 111*b* of the discharge opening 111. In one or more embodiments, the second platform 130 may be spaced by a distance D2 from an optional vertical wall 140 of the applicator member 100. Generally speaking, second platform 130 may be configured to hold or confine a second amount or portion of hair, where the second amount or portion of hair may be greater than the first amount or portion of hair held, tabled, or confined by the first platform 120.

The second platform 130 may define or include a cutout 138 between a first pylon 132 and a second pylon 134 of the second platform 130. As illustrated in FIG. 1, for instance, the second platform 130 may have only one cutout, that is, the cutout 138. Thus, the second platform 130 may hold or confine the second amount or portion of hair in the cutout 138, between the first pylon 132 and the second pylon 134.

The second platform 130 may include bridge portion 136 that bridges or connects the first pylon 132 and the second pylon 134. Optionally, the bridge portion 136 may be offset or raised above the upper surface 112 of base 110. For example, bridge portion 136 may be raised above the upper surface 112 of base 110 at least by a distance D1. Such offset of the bridge portion 136 may allow or provide for containment of hair care product output from the discharge opening 111 radially inward of the bridge portion 136. The first pylon 132 and the second pylon 134 may also provide for containment of hair care product output from the discharge opening 111 radially inward of the second platform 130.

Figure 3:
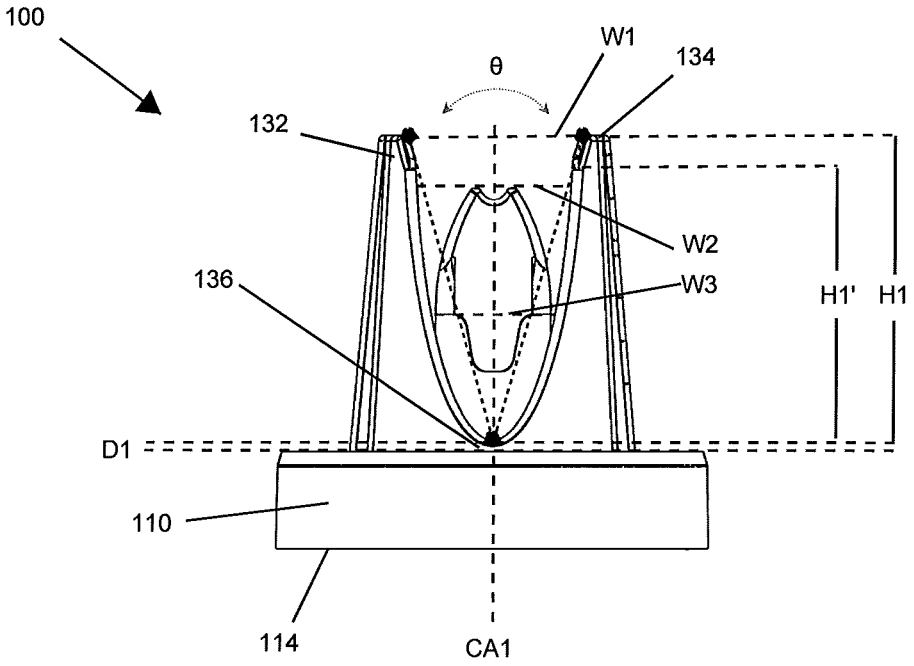
FIG. 3 is a front elevational view of the applicator member of FIG. 1.
Figure 4:
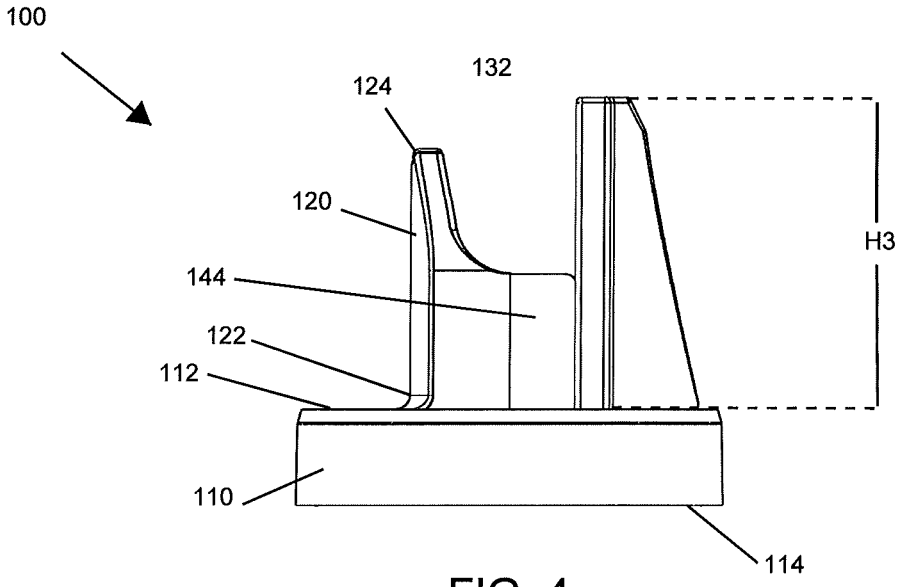
FIG. 4 is a right side elevational view of the applicator member of FIG. 1.
Figure 5:
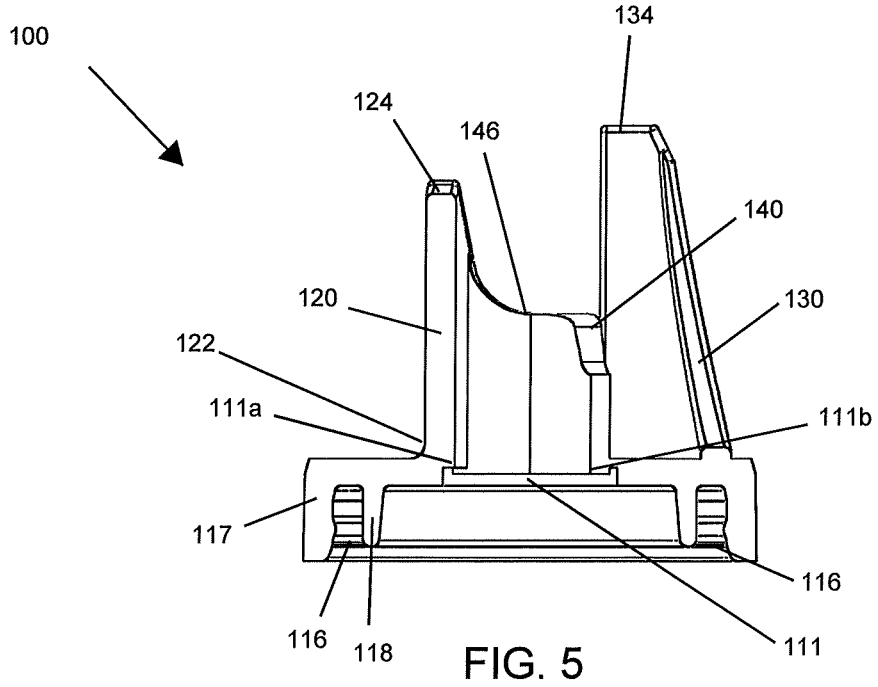
FIG. 5 is a right-facing cross-sectional view of the applicator member of FIG. 1.

Optionally, in one or more embodiments, a width W1 of a first part of the cutout 138 farthest from the upper surface 114 of the base 110 may be wider than a second part of the cutout 138 closest to the upper surface 114 of the base 110. Thus, the cutout 138 may be one of an arc, such as illustrated in FIGS. 1-3, U-shaped or V-shaped, for instance. As such, the geometry of the cutout 138 may cause the second amount or portion of hair to become more densely arranged toward and at the second part of the cutout 138 closest to the upper surface 114 of the base 110.

Further, optionally, a height H1 of the cutout 138 may be greater than or equal to a width W1 of a first part of the cutout 138. Thus, the cutout 138 may have a ratio of preferably about 1:1 or more preferably about 5:1 in terms of height and width. Non-limiting examples of values for the width W1 of the first part of the cutout 138 are preferably from about 1.5 millimeters to about 15 millimeters or more preferably from about 2.5 millimeters to about 12 millimeters. Further, though FIG. 2 illustrates width W1 of the first part of the cutout 138 as being defined from the top surfaces of the first pylon 132 and the second pylon 134, alternatively, in one or more embodiments the first part of the cutout 138 may be defined as slightly below the top surfaces of the first pylon 132 and the second pylon 134, for instance, according to a height H1' illustrated in FIG. 3. Thus, in one or more embodiments of the disclosed subject matter, the height H1 of the cutout 138 may be less than a height H3 of the first pylon 132 and the second pylon 134, particularly because of the offset of the bridge portion 136 by the distance D1 and/or in an embodiment where the top surfaces of the first pylon 132 and the second pylon 134 do not form the first part of the cutout 138 farthest from the upper surface 114 of the base 110. Also, as illustrated in FIG. 3, for instance, the bridge portion 136 and/or the second part of the cutout 138 closest to the upper surface 114 of the base 110 can be lower than the free end 124 of the first platform 120.

As shown in the side elevational view FIG. 3, an angle θ, which may be bisected by a central vertical axis CA1 of the cutout 138, can be formed by line segments from a first end point of the second part of the cutout 138 closest to the upper surface 112 of the base 110 and respective portions of the first pylon 132 and second pylon 134 that define the width W1 of the first part of the cutout 138. Further, in one or more embodiments, the angle θ is acute. Non-limiting values of angles for angle θ can be preferably from about 15 degrees to about 75 degrees, more preferably from about 20 degrees to about 65 degrees, even more preferably from about 25 to about 60 degrees. Incidentally, FIG. 3 also illustrates that the central vertical axis CA1 of the cutout 138 may be aligned with a central vertical axis of the first platform 120, which is also represented as CA1 in this figure.

As noted above, the first platform 120 may be configured to hold or table a first amount or portion of hair. Further, the second platform 130 may be configured to hold or confine a second amount of hair in the cutout 138, between the first pylon 132 and the second pylon 134. The second amount of hair associated with the second platform 130 may be greater than the first amount of hair associated with the first platform 120.

The vertical wall 140 may extend from the base 110 adjacent or at the second side 111*b* of the discharge opening 111, for instance. Thus, in one or more embodiments, the vertical wall 140 may define a portion of an inner surface of the discharge opening 111. Further, as can be seen from FIG. 6, the vertical wall 140 may be between the first platform 120 and the second platform 130, spaced from the second platform 130 by the distance D2, for instance. Also, as can be seen from FIG. 6, for instance, a distance from the first pylon 132 to the second pylon 134 along a line tangential to the vertical wall 140 can correspond to a distance D3. In one or more embodiments, the distance D3 can be preferably about 2.5 mm to about 16 mm, or more preferably from about 4 mm to about 8 mm.

Optionally, the vertical wall 140 may define a cutout 142. The cutout 142 may have a bottom-most portion that is higher than the upper surface 112 of the base 110 as compared to the bridge portion 136. Put another way, the second part of the cutout 138 closest to the upper surface 114 of the base 110 may be closer to the upper surface 114 of the base 110 than the bottom-most portion of the cutout 142. Generally speaking, the cutout 142 may be configured to allow or direct hair care product output from the discharge opening 111 toward the second platform 130. For example, the cutout 142 may allow or direct hair care product to flow to and accumulate in a space in the distance D2 between the vertical wall 140 and the second platform 130.

In one or more embodiments of the disclosed subject matter, the vertical wall 140 and the first platform 120 may be connected by a sidewall 144 and a sidewall 146. The sidewall 144 and the sidewall 146 may extend from the upper surface 112 of the base 110 adjacent or at opposite sides of the discharge opening 111. Further, the sidewall 144 and the sidewall 146 may extend to a same height above the upper surface 112 of the base 110. Thus, in one or more embodiments, the sidewall 144 and the sidewall 146 may each define a portion of an inner surface of the discharge opening 111. In one or more embodiments, a height of each of the sidewall 144 and the sidewall 146 may the same as a height of the vertical wall 140, excepting, of course, the height of the cutout 142 in one or more embodiments that have the cutout 142. Further, the height H2 of the first platform 120 can be greater than the height of the vertical wall 140 and/or the height of each of the sidewall 144 and the sidewall 146.

Figure 6:
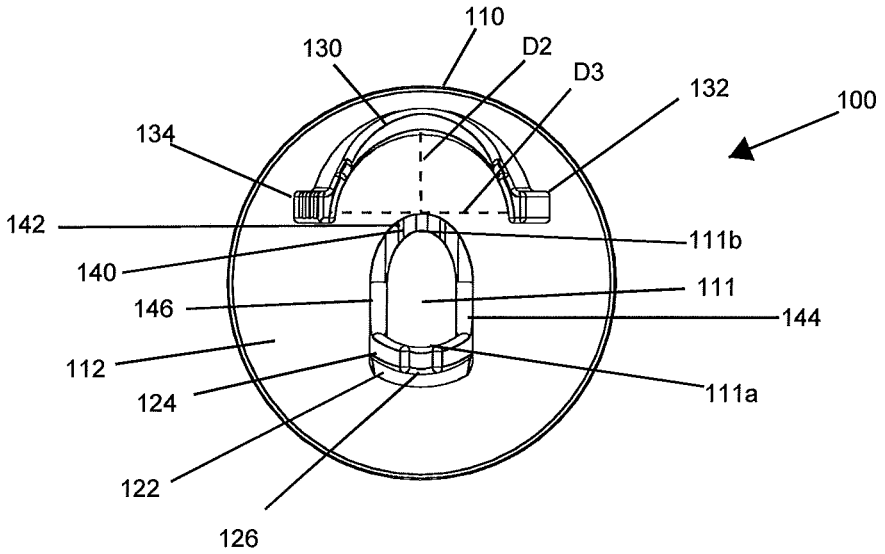
FIG. 6 is a top plan view of the applicator member of FIG. 1.
Figure 7:
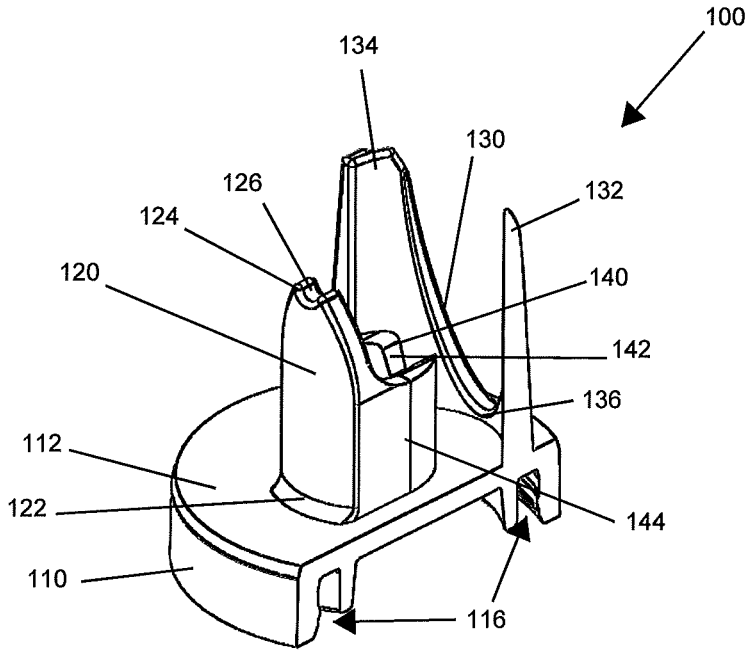
FIG. 7 is a partial right side perspective sectional view of the applicator member of FIG. 1.
Figure 8:
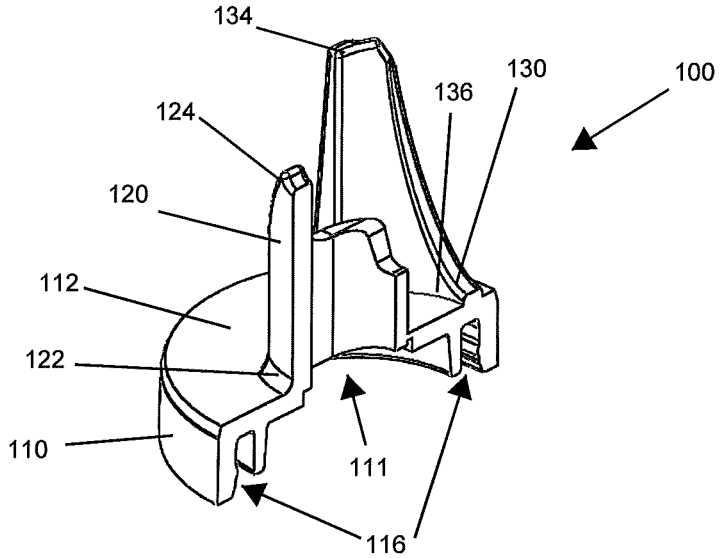
FIG. 8 is a partial right side perspective sectional view of the applicator member of FIG. 1.

In one or more embodiments of the disclosed subject matter, the first platform 120, the vertical wall 140, the sidewall 144, and the sidewall 146 may be configured to receive hair care product output from the discharge opening 111. Further, the first platform 120, the vertical wall 140, the sidewall 144, and the sidewall 146 may be configured to output the hair care product, for instance, at least to a space in the distance D2 between the vertical wall 140 and the second platform 130 and/or directly to a portion of hair between the first platform 120 and the second platform 130. Thus, in one or more embodiments of the disclosed subject matter, the first platform 120, the vertical wall 140, the sidewall 144, and the sidewall 146 may form a nozzle. Such nozzle, in an overhead plan view, may be circular, generally circular, square, rectangular, arched, or a combination of all or some of the foregoing shape portions, such as illustrated in FIG. 6.

As illustrated in FIG. 2, for instance, the width W4 of the platform base 122 of the first platform 120 where the first platform 120 extends from the base 110 may be less than a width W2 of the cutout 138 at a height parallel to the height H2 of the free end 124 of the first platform 120. Also, the width of the cutout 138 below the height H2 of the free end 124 may be less than the width W4 of the platform base 122. For example, a width W3 of the cutout 138 at the height of the cutout 142 of the vertical wall 140 may be less than a width of the first platform 120 at that height, for instance. Some or all of such dimensional relationships can cause separation of the group of stands of hair in the cutout 138 of the second platform 130 between a subgroup of strands of hair of the group associated with the first platform 120 and subgroups of strands of hair provided on sides of the sidewall 144 and the sidewall 146. Such separation of the group of stands of hair may allow hair care product output at the tops of the vertical wall 140, the sidewall 144, and the sidewall 146 to fill the gaps between the respective subgroups of stands of hair. Further, such dimensional relationships can cause the second amount or portion of hair to become more densely arranged toward and at the second part of the cutout 138 closest to the upper surface 114 of the base 110.

Figure 9:
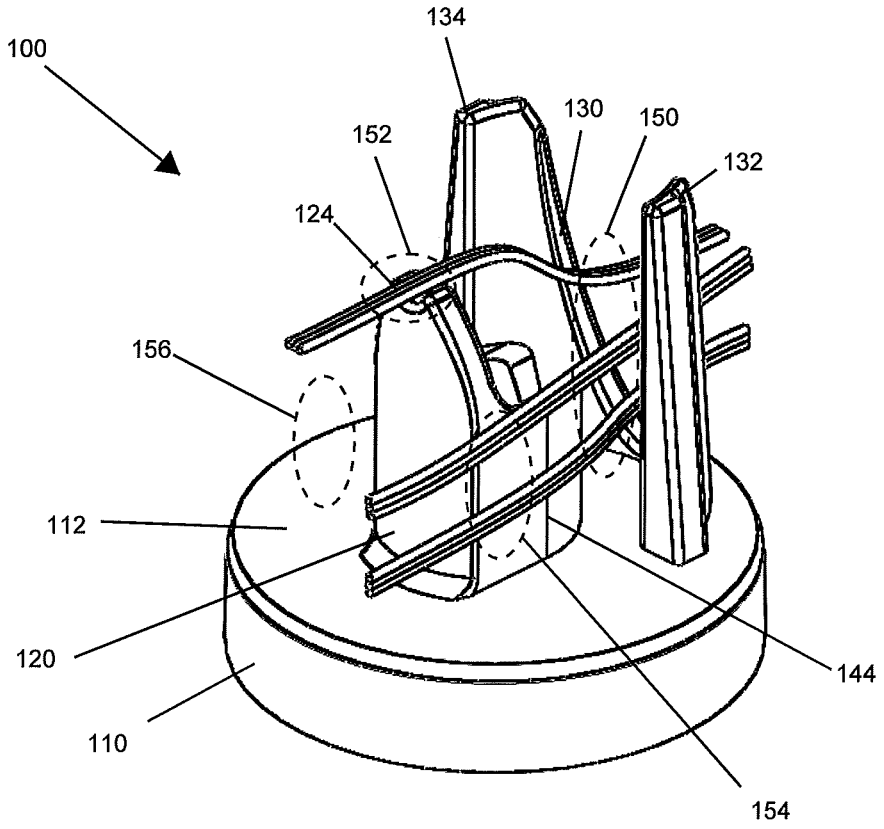
FIG. 9 is a diagrammatic representation of use of the applicator member of FIG. 1 according to one or more embodiments of the disclosed subject matter.
Figure 10:
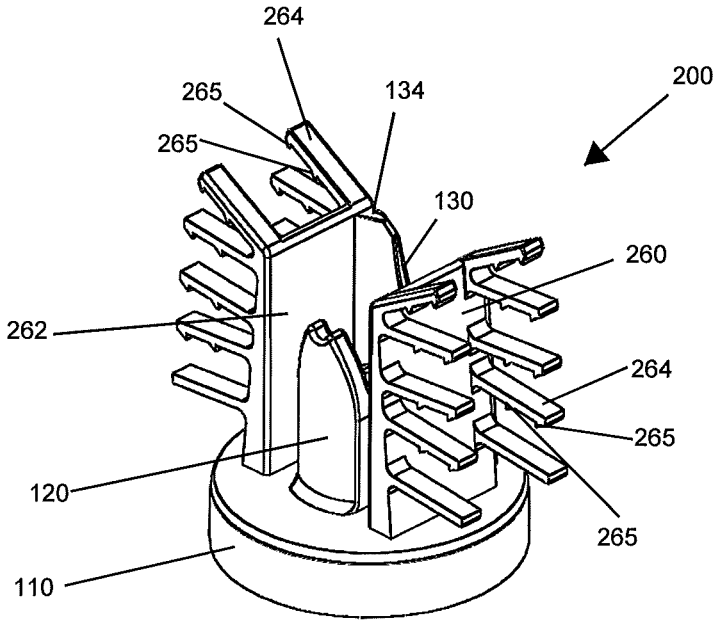
FIG. 10 is a rear right side perspective view of a variation of the applicator member of FIG. 1, according to one or more embodiments of the disclosed subject matter.
Figure 11:
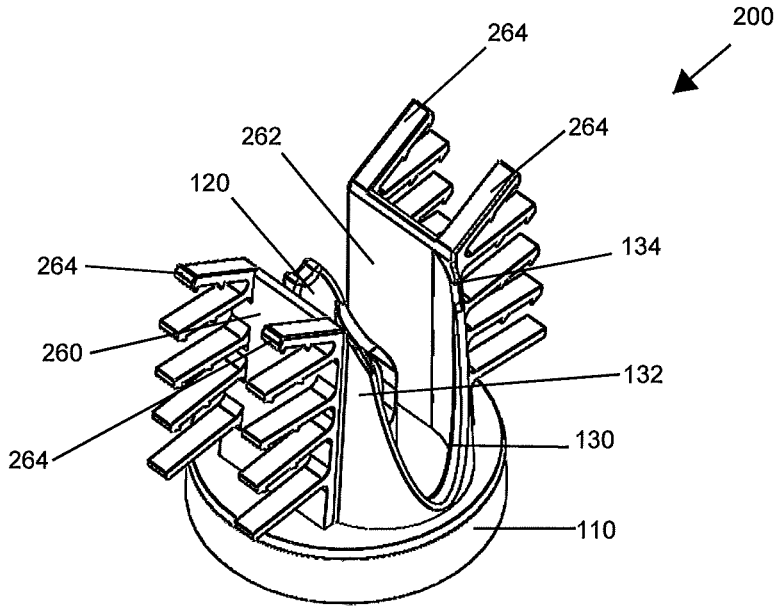
FIG. 11 is a front right side perspective view of the applicator member of FIG. 10.
Figure 12:
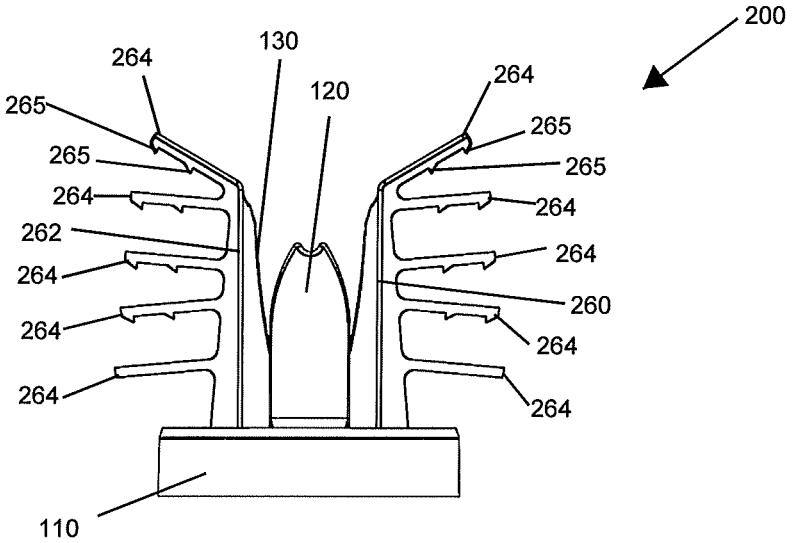
FIG. 12 is a rear elevational view of the applicator member of FIG. 10.
Figure 13:
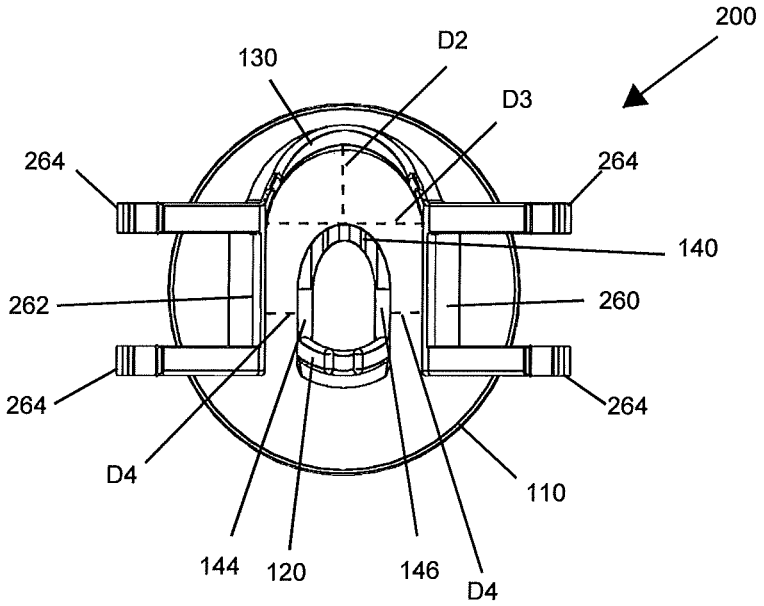
FIG. 13 is a top plan view of the applicator member of FIG. 10.
Figure 14:
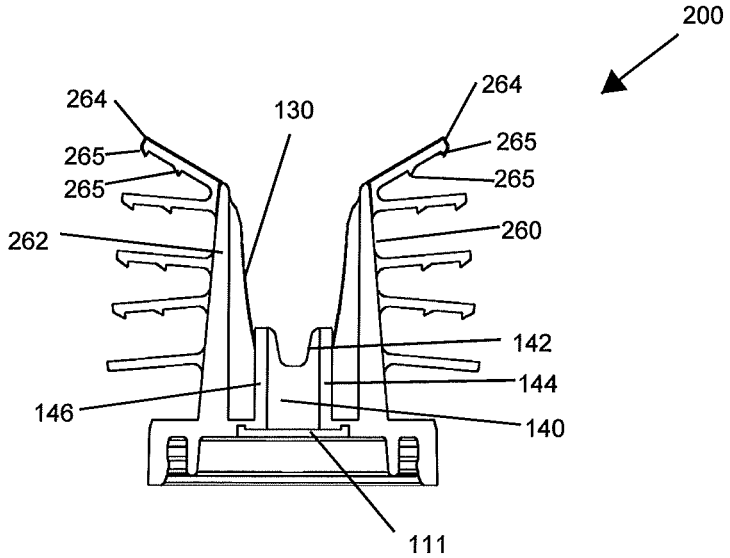
FIG. 14 rear-facing cross-sectional view of the applicator member of FIG. 10.

FIG. 9 is a diagrammatic representation of use of the applicator member 100 of FIG. 1 according to one or more embodiments of the disclosed subject matter. Generally speaking, the applicator member 100 may be positioned such that the second platform 130 is on a root side of the hair and the first platform 120 is on an end or tip side of the hair.

The applicator member 100 may be brought into contact with a group of strands of hair 150. The group of strands of hair 150 may have an amount or portion of hair, which may be referred to herein as a second amount or portion of hair. Further, the group of strands of hair 150 may be provided at the second platform 130, for instance, in the cutout 138, so as to hold or confine the group of strands of hair between the first pylon 132 and the second pylon 134 of the first platform 130. Thus, the second platform 130 can be configured to hold or confine at least the amount of hair of the group of strands of hair 150. Of course, though FIG. 9 illustrates only nine stands of hair in the cutout 138, this figure is merely diagrammatic in nature and should not be interpreted as limiting the second platform 130 from holding or confining only three strands of hair.

The group of strands of hair 150 may be separated into multiple subgroups. In particular, a subgroup of strands of hair 152, which may be referred to herein as a first amount or portion of hair, can be held, tabled, or confined by the free end 124 of the first platform 120. For example, FIG. 9 shows the subgroup of strands of hair 152 being confined in the cutout 126. The amount of hair of the subgroup of strands of hair 152 may be less than the amount of hair of the group of strands of hair 150. Further, though FIG. 9 illustrates only three stand of hair in the cutout 126, this figure is merely diagrammatic in nature and should not be interpreted as limiting the first platform 120 from holding, tabling or confining only one strand of hair. Indeed, in embodiments of the disclosed subject matter the first platform 120 may be configured to hold one or more strands of hair.

The group of strands of hair 150 may also be separated into a subgroup of strands of hair 154, which may be referred to herein as a third amount or portion of hair. The subgroup of strands of hair 154 may be provided adjacent the sidewall 144, on or adjacent the upper surface 112 of the base 110, for instance. The amount of hair of the subgroup of strands of hair 154 may be less than the amount of hair of the group of strands of hair 150. In one or more embodiments of the disclosed subject matter, the amount of hair of the subgroup of strands of hair 154 may be greater than the amount of hair of the subgroup of strands of hair 152. Thus, a space adjacent the sidewall 144 may be configured to hold the amount of hair of the subgroup of strands of hair 154, which may be greater than the amount of hair of the subgroup of strands of hair 152. Alternatively, the amount of hair of the subgroup of strands of hair 154 may be the same or substantially the same as the amount of hair of the subgroup of strands of hair 152. Thus, in one or more embodiments, the space adjacent the sidewall 144 may be configured to hold the amount of hair of the subgroup of strands of hair 154, which may be the same or substantially the same as the amount of hair of the subgroup of strands of hair 152.

Not expressly illustrated in FIG. 9, the group of strands of hair 150 may also be separated into a subgroup of strands of hair 156, which may be referred to herein as a fourth amount or portion of hair. The subgroup of strands of hair 156 may be provided adjacent the sidewall 146, on or adjacent the upper surface 112 of the base 110, for instance. The amount of hair of the subgroup of strands of hair 156 may be less than the amount of hair of the group of strands of hair 150. In one or more embodiments of the disclosed subject matter, the amount of hair of the subgroup of strands of hair 156 may be greater than the amount of hair of the subgroup of strands of hair 152. Thus, a space adjacent the sidewall 146 may be configured to hold the amount of hair of the subgroup of strands of hair 156, which may be greater than the amount of hair of the subgroup of strands of hair 152. Alternatively, the amount of hair of the subgroup of strands of hair 156 may be the same or substantially the same as the amount of hair of the subgroup of strands of hair 152. Thus, in one or more embodiments, the space adjacent the sidewall 146 may be configured to hold the amount of hair of the subgroup of strands of hair 154, which may be the same or substantially the same as the amount of hair of the subgroup of strands of hair 152. Also, the amount of hair of the subgroup of strands of hair 156 may be the same or substantially the same as the amount of hair of the subgroup of strands of hair 154. Thus, the respective spaces adjacent the sidewall 144 and the sidewall 146 may be configured to hold the same amount of hair.

With the group of strands of hair 150 arranged as set forth above, for instance, the applicator member 100 may be moved the direction toward the ends of the strands of hair of the group of strands of hair 150. Hair care product may be output from prior to providing the applicator member 100 to the hair, once the applicator member 100 is arranged as set forth above, and/or as the applicator member 100 is being moved in the direction toward the ends of the strands of hair of the group of strands of hair 150.

FIGS. 10-14 show various views of an applicator member 200 according to one or more embodiments of the disclosed subject matter. Generally speaking, applicator member 200 may be a variation of applicator member 100. Notably, applicator member 200 can additionally include an outer wall 260 and an outer wall 262 extending from the upper surface 112 of the base 110, which may extend to a same height. Applicator member 200 preferably can be made of polypropylene (PP), polyethylene (PE), polyethylene terephthalate (PET), acrylonitrile butadiene styrene (ABS), or acrylic; more preferably of polypropylene (PP) or polyethylene (PE); even more preferably of polypropylene (PP).

Optionally, the outer wall 260 may also extend from the pylon 132. Likewise, optionally, the outer wall 262 may also extend from the pylon 134. In one or more embodiments, no space may exist between the outer wall 260 and the pylon 132 and the outer wall 262 and the pylon 134. Such configuration may contain hair care product output from the discharge opening 111 in the spaces between the outer walls 260, 262 and the vertical wall 140 and/or sidewalls 144, 146. Also, the outer walls 260, 262 may not be connected to the first platform 120, and the height of the outer walls 260, 262 may be greater than the height H2 of the first platform 120. As can be seen from FIG. 12, for instance, respective spaces between the outer walls 260, 262 and the first platform 120 may not overlap the cutout 138 in the side elevational view of the applicator member 200 of FIG. 12. Also, as can be seen from FIG. 13, for instance, the outer wall 260 may be spaced by a distance D4 from the sidewall 146. Likewise, the outer wall 262 may be spaced by the distance D4 from the sidewall 144. The distance D4 preferably may be about 1 to about 4 mm, or more preferably about 1.5 mm. Generally speaking, each distance D4 may correspond to a space or area where hair is not confined for the application of hair care product. That is, hair care product may not be applied to strands of hair provided between the outer wall 260 and the sidewall 146 and between the outer wall 262 and the sidewall 144.

Each of the outer walls 260, 262 can have one or more bristles 264. FIGS. 10-14, for instance, show that each of the outer walls 260, 262 can have a plurality of bristles 264. Generally, the one or more bristles 264 may be configured to separate and/or support associated portions of hair other than the strands of hair of the group of strands of hair 150. The bristles 264, which may be in rows of two for each outer wall 260, 262, can extend from an outer surface of the outer walls 260, 262. The bristles 264 may extend at a same angle or at different angles from the outer walls 260, 262. Further, the bristles 264 may be of the same or different configuration. As illustrated in FIGS. 10-14, some bristles 264 may have one or more projections 265, and some bristles 264 may not have any projections. Thus, in one or more embodiments, the bristles 264 may be configured differently, such as illustrated in FIGS. 10-14. Alternatively, all of the bristles 264 may be the same. Of course, whether the bristles 264 are of the same or different configurations, the angles at which they project from the outer walls 260, 262 may be the same or different.

Figure 15:
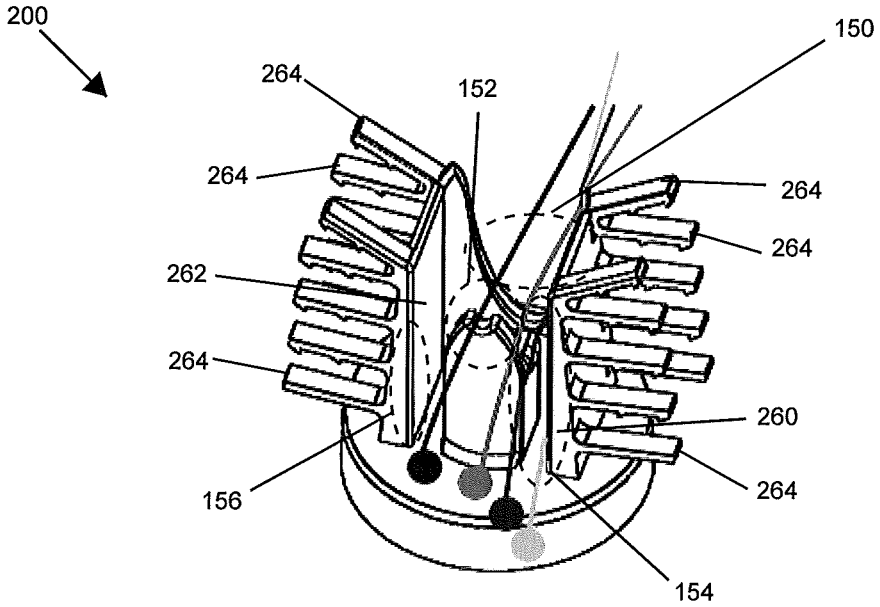
FIG. 15 is a diagrammatic representation of use of the applicator member of FIG. 10 according to one or more embodiments of the disclosed subject matter.

FIG. 15 is a diagrammatic representation of use of the applicator member 200 of FIGS. 10-14, according to one or more embodiments of the disclosed subject matter. The use of the applicator member 200 can be similar to the discussion above for FIG. 9. However, for the use of the applicator member 200 the space adjacent the sidewall 144 to hold the amount of hair of the subgroup of strands of hair 154 can be defined by the outer wall 260. Likewise, the space adjacent the sidewall 146 to hold the amount of hair of the subgroup of strands of hair 156 can be defined by the outer wall 262.

Figure 16:
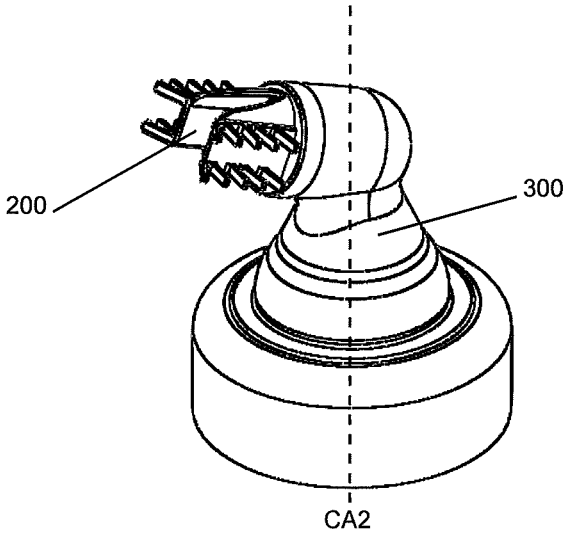
FIG. 16 is a perspective view of the applicator member of FIG. 10 and a connection interface, according to one or more embodiments of the disclosed subject matter.

FIG. 16 is a perspective view of the applicator member 200 of FIGS. 10-14 and an angled connection interface 300, according to one or more embodiments of the disclosed subject matter. Of course, applicator member 100 of FIGS. 1-8 may also be connectable to the angled connection interface 300. The connection interface 300 may connect to the applicator member 200 removably or fixedly. For example, the applicator member 200 may be snap fit to the angled connection interface 300 via the connection interface 116 of the base 110. Alternatively, the connection interface 116 can be threaded and therefor threaded onto the angled connection interface 300. The angle of the angled connection interface 300 may be acute, for example, about 30 degrees relative to a central vertical axis CA2 of a base of the angled connection interface 300. Thus, the applicator member 200 can extend from the angled connection interface 300 at an acute angle relative to the central vertical axis CA2.

Figure 17:
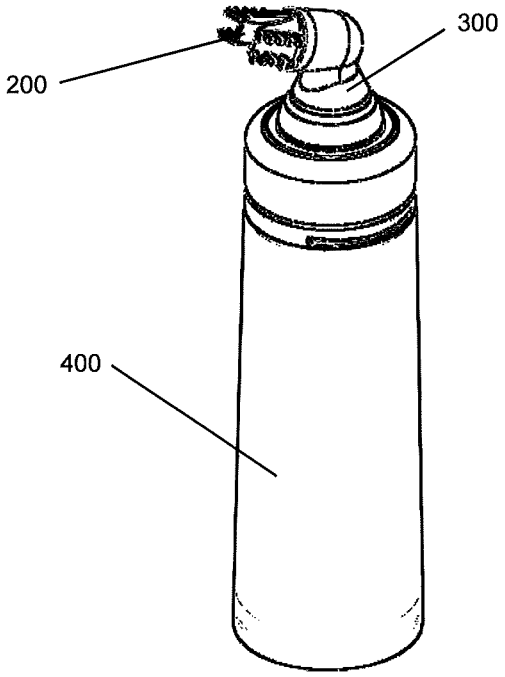
FIG. 17 is a perspective view of a hair care product dispenser with the applicator member and connection interface of FIG. 16.
Figure 18:
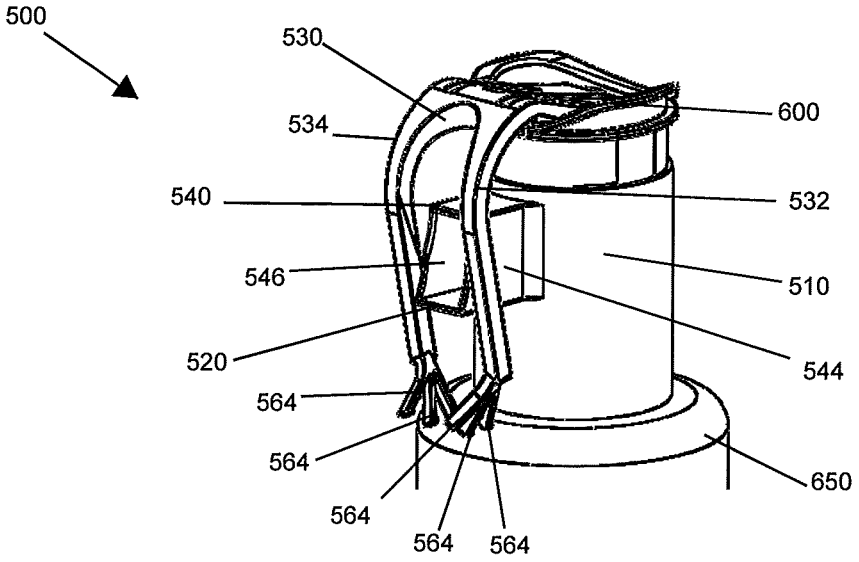
FIG. 18 is a right side perspective view of an applicator member to apply or dispense hair care product according to one or more embodiments of the disclosed subject matter.

FIG. 17 is a perspective view of a hair care product container 400 with the applicator member 200 and angled connection interface 300 of FIG. 16. The hair care product container 400 may hold a predetermined amount of hair care product and can be removably or fixedly coupled to the base of the angled connection interface 300. The central vertical axis CA2 of the base of the angled connection interface 300 may also correspond to a central longitudinal axis of the hair care product container 400. Thus, the applicator member 200 may be angled relative to the central longitudinal axis of the hair care product container 400 at an acute angle, about 30 degrees, for instance. Hair care product can be stored in hair care product container 400 and provided to applicator member 200 for output via the angled connection interface 300. For example, the hair care product container 400 may be squeezed to cause hair care product stored therein to exit through the top of the hair care product container 400 to the angled connection interface 300 and to the applicator member 200 for output via the discharge opening 111 of the applicator member 200. As noted above, the applicator member 200 preferably can be made of polypropylene (PP), polyethylene (PE), polyethylene terephthalate (PET), acrylonitrile butadiene styrene (ABS), or acrylic; more preferably of polypropylene (PP) or polyethylene (PE); even more preferably of polypropylene (PP). The angled connection interface 300 preferably can be made of polypropylene (PP), polyethylene (PE), or polyethylene terephthalate (PET), or more preferably of polypropylene (PP). The hair care product container 400 preferably can be made of metal, glass, polypropylene (PP), or polyethylene terephthalate (PET), or more preferably of polypropylene (PP).

FIGS. 18-26 are various views of an applicator member 500 according to one or more embodiments of the disclosed subject matter. The applicator member 500 may be configured to provide hair care product, such as hair dye, to hair of a user from a hair care product container 650, for instance.

The applicator member 500 can be comprised of a base 510 that defines a discharge opening 511 with a first side 511*a* and a second side 511*b*, a first platform 520, and a second platform 530. The applicator member 500 may also be comprised of a first arm 532 and a second arm 534 extending from the second platform 530.

The first platform 520 may extend from the base 510 adjacent or at the first side 511*a* of the discharge opening 511. Thus, in one or more embodiments, the platform base of the first platform 520 may define a portion of an inner surface of the discharge opening 511. An upper edge or surface of the first platform 520, which may be referred to herein as a free end, can be flat, as illustrated in FIGS. 18-26, for instance. Alternatively, the upper edge or surface of the first platform 520 may be serrated, uneven, grooved or convex, or have a cutout or otherwise be concave. Thus, in some embodiments the first platform 520 may be configured to hold or table a first amount or portion of hair. In other embodiments the first platform 520 may additionally confine the hair. A width W6 of the first platform may be preferably about 6 mm.

The second platform 530 may be provided adjacent the second side 511*b* of the discharge opening 511. In particular, the second platform 530 may extend from interface mechanism 600 and be provided adjacent to, but spaced from, the discharge opening 511 by a distance. Discussed in more detail below, the second platform 530 may be rotatable relative to the first platform 520.

The second platform 530, which may define a cutout or receptacle, may generally have a base that forms a narrowest part of the second platform 530. For example, FIGS. 18-26 generally show the second platform 530 having an arc configuration, with the narrowest part closest to the interface mechanism 600. But in other embodiments the second platform 530 may be U-shaped or V-shaped, for instance. Such configuration of the second platform 530 may cause the second amount or portion of hair to become more densely arranged toward and at the base of the second platform 530.

Figure 22:
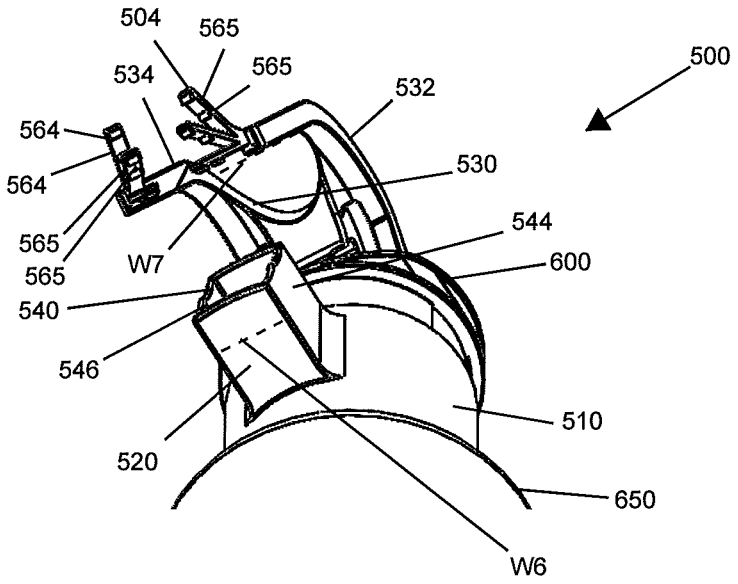
FIG. 22 is a right side, rear perspective view of the applicator member of FIG. 18.

Further, optionally, a height of the cutout or receptacle formed by the second platform 530 may be greater than or equal to a width of a first part of the cutout or receptacle of the second platform 530, for instance, at interfaces of whether the second platform 530 meets the first arm 532 and the second arm 534. Thus, the cutout or receptacle formed by the second platform 530 may have a ratio of preferably about 1:1 or more preferably about 5:1 in terms of height and width. Also, optionally, the base of the second platform 530 may be raised above the base 510. The base of the second platform 530 may also be raised or have a height above a height of the first platform 520. In one or more embodiments, the uppermost part of the cutout or receptacle formed by the second platform 530 may have a width W7, as illustrated in FIG. 22, for instance. The width W7 may be preferably about 8 mm.

As noted above, the first platform 520 may be configured to hold or table a first amount or portion of hair. Further, the second platform 530 may be configured to hold or confine a second amount of hair. The second amount of hair associated with the second platform 530 can be greater than the first amount of hair associated with the first platform 520.

In one or more embodiments of the disclosed subject matter, the applicator member 500 may also comprise a vertical wall 540. The vertical wall 540 may extend from the base 510 adjacent or at the second side 511*b* of the discharge opening 511, for instance. Thus, in one or more embodiments, the vertical wall 540 may define a portion of an inner surface of the discharge opening 511. Further, the vertical wall 540 may be between the first platform 520 and the second platform 530, spaced from the second platform 530 by a distance. The height of the vertical wall 540 may be higher than the height of the second platform 530, but less than the height of the first platform 520.

In one or more embodiments of the disclosed subject matter, the vertical wall 540 and the first platform 520 may be connected by a sidewall 544 and a sidewall 546. The sidewall 544 and the sidewall 546 may extend from the base 510 adjacent or at opposite sides of the discharge opening 511. Further, the sidewall 544 and the sidewall 546 may extend to a same height above the base 510. Thus, in one or more embodiments, the sidewall 544 and the sidewall 546 may each define a portion of an inner surface of the discharge opening 511. Optionally, each of the sidewalls 544, 546 may vary in height, increasing from the vertical wall 540 to the first platform 520, for instance.

Figure 19:
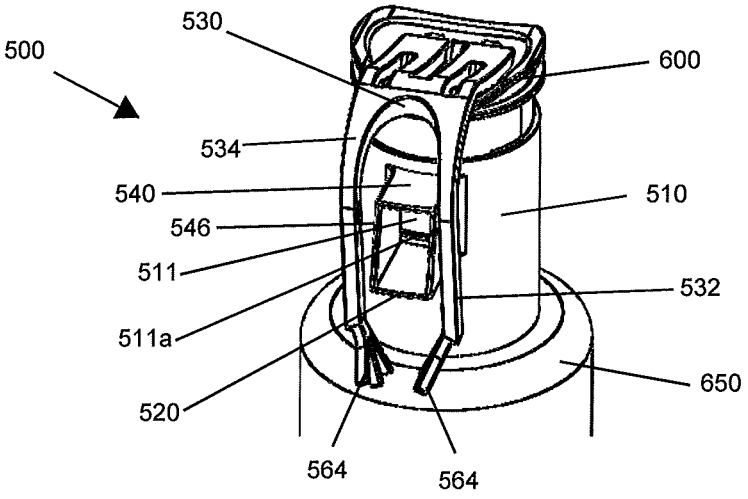
FIG. 19 is a right side, top perspective view of the applicator member of FIG. 18.
Figure 20:
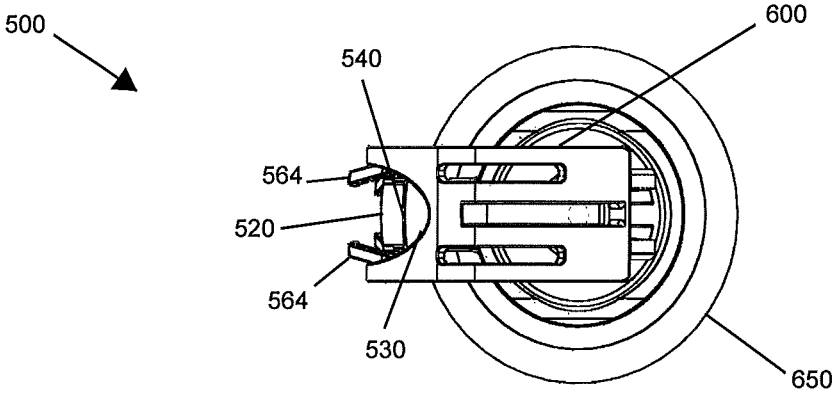
FIG. 20 is a top plan view of the applicator member of FIG. 18.
Figure 21:
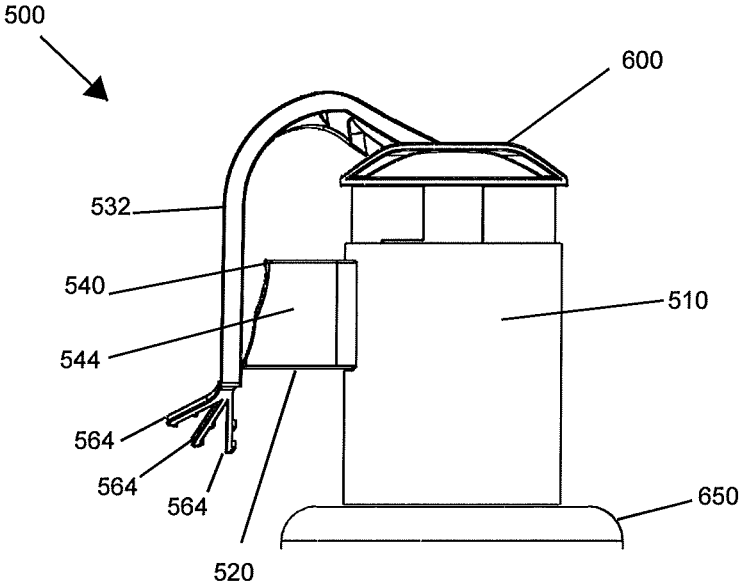
FIG. 21 is a right side elevational view of the applicator member of FIG. 18.

In one or more embodiments of the disclosed subject matter, the first platform 520, the vertical wall 540, the sidewall 544, and the sidewall 546 may be configured to receive hair care product output from the discharge opening 511. Further, the first platform 520, the vertical wall 540, the sidewall 544, and the sidewall 546 may be configured to output the hair care product, for instance, directly to a portion of hair between the first platform 520 and the second platform 530. Thus, in one or more embodiments of the disclosed subject matter, the first platform 520, the vertical wall 540, the sidewall 544, and the sidewall 546 may form a nozzle. The nozzle, in an overhead plan view, may be rectangular, such as illustrated in FIG. 19, or circular, generally circular, square, oval, or a combination of all or some of the foregoing shape portions.

A width of the base of the first platform 520 where the first platform 520 extends from the base 510 may be less than a width of the cutout or receptacle of the second platform 530 at a height parallel to the height of the free end or top of the first platform 520. Also, the width of the cutout or receptacle of the second platform 530 below the height of the free end or top of the first platform 520 may be less than the width of the base of the first platform 520. Some or all of such dimensional relationships can cause separation of the group of stands of hair in the cutout or receptacle of the second platform 530 between a subgroup of strands of hair of the group associated with the first platform 520 and subgroups of strands of hair provided on sides of the sidewall 544 and the sidewall 546. Such separation of the group of stands of hair may allow hair care product output at the tops of the vertical wall 540, the sidewall 544, and the sidewall 546 to fill the gaps between the respective subgroups of stands of hair.

Ends of each of the first arm 532 and the second arm 534 can have one or more bristles 564. FIGS. 18-26, for instance, show that each of the first arm 532 and the second arm 534 can have a plurality of bristles 564. Generally, the one or more bristles 564 may be configured to separate and/or support associated portions of hair. Optionally, each of the bristles 564 may have one or more projections 565.

Figure 23:
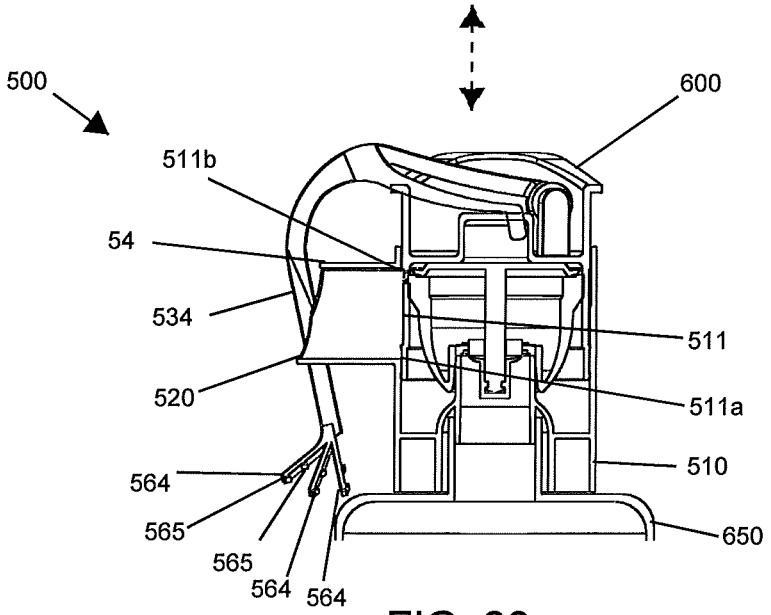
FIG. 23 is a right-facing cross-sectional view of the applicator member of FIG. 18 in a first state.
Figure 24:
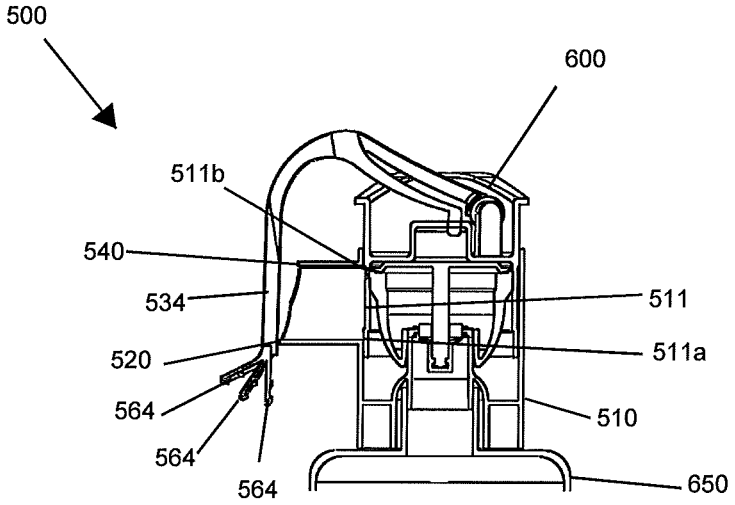
FIG. 24 is a right-facing cross-sectional view of the applicator member of FIG. 18 in a second state.
Figure 25:
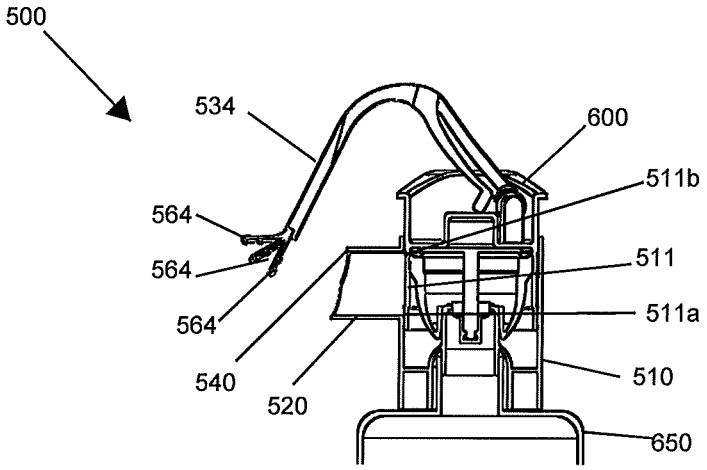
FIG. 25 is a right-facing cross-sectional view of the applicator member of FIG. 18 in a third state.
Figure 26:
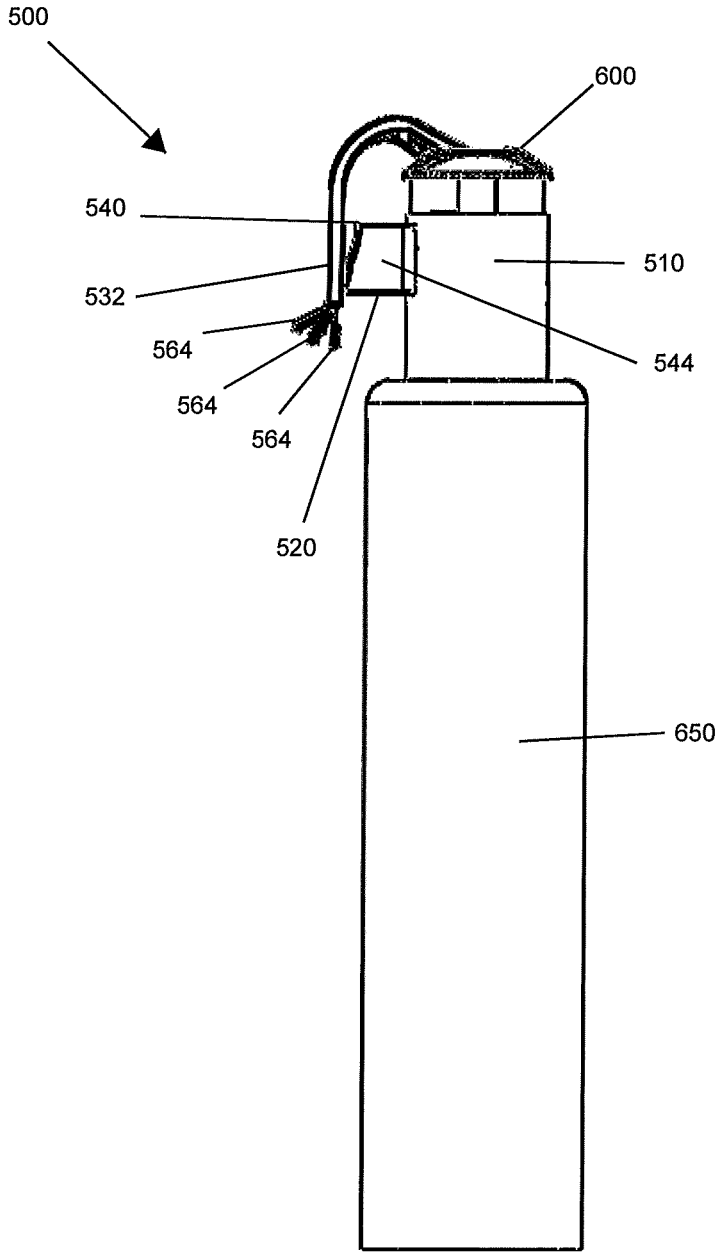
FIG. 26 is a right side elevational view of a hair care product dispenser with the applicator member of FIG. 18.

FIGS. 23-25 show cross-sectional views of the applicator member 500 in various states. FIG. 23, for instance, illustrates the applicator member 500 in a first state, a fully closed state. Notably, the first arm 532 and the second arm 534 overlap the first platform 520 in the side view. In this state the applicator member 500 may receive and output hair care product from the hair care product container 650 via depression of a button or actuator of the interface mechanism 600 (see double arrowed line). When the depression force is released, the button or actuator of the interface mechanism 600 may move away from the hair care product container 650. FIG. 24 illustrates the applicator member 500 in a second state, an intermediate state, where the first arm 532, the second arm 534, and the second platform 530 have been rotated clockwise. Optionally, in the intermediate state, the interface mechanism 600 may prevent hair care product from being output from the hair care product container 650 to the discharge opening 511. FIG. 25 illustrates the applicator member 500 in a third state, a fully open state, where the first arm 532, the second arm 534, and the second platform 530 have been rotated clockwise from the intermediate state of FIG. 24. Optionally, in the fully open state, the interface mechanism 600 may prevent hair care product from being output from the hair care product container 650 to the discharge opening 511. Of course, the first arm 532, the second arm 534, and the second platform 530 may be rotated from the full open position to the fully closed position.

Figure 27:
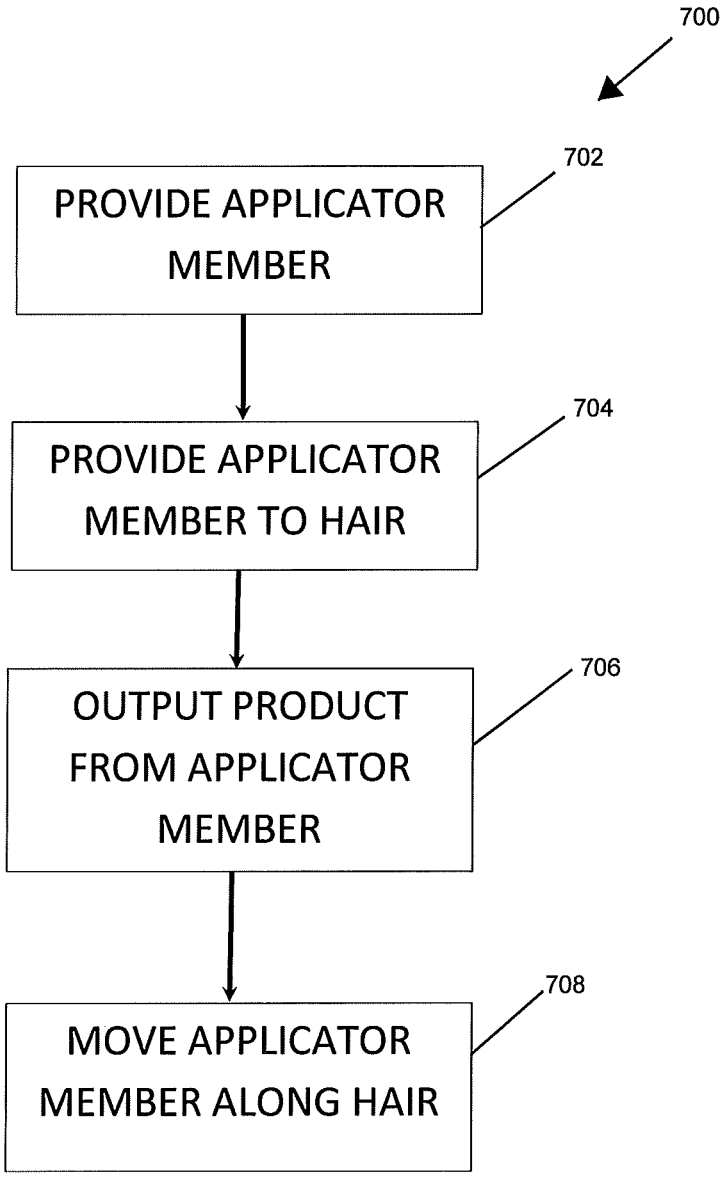
FIG. 27 is a flow diagram of a method according to one or more embodiments of the disclosed subject matter.

FIG. 27 is a flow diagram of a method 700 according to one or more embodiments of the disclosed subject matter.

At block, 702 the method 700 can comprise providing an applicator member, such as applicator member 100, 200, or 500 alone, or in combination with a system or apparatus thereof. Optionally, the method 700 can include brushing an area of hair to be treated with hair care product to remove tangles, for instance.

At block 704 the method can comprise providing the applicator member such as applicator member 100, 200, or 500 to an area of hair. Generally speaking, such providing the applicator member can include, for a group of strands of hair, providing a first part of the group of strands of hair to a second platform, such as second platform 130, 530, where the first part of the group of stands of hair may correspond to the second amount of hair discussed above. The providing may also include providing a second part of the group of strands of hair on a first platform, such as first platform 120, 520, where the second part of the group of strands of hair may correspond to the first amount of hair discussed above. The first part of the group of strands of hair can be more toward the roots of the strands of hair than the second part of the group of strands of hair.

More specifically in the case of the applicator members 100, 200, the group of strands of hair can be picked up by hand or by the bristles 264 of one outer wall 260, 262 in the case of the applicator member 200. With the group of hair held by hand, the applicator member 100, 200 can be provided to the group of strands of hair such that the first part of the group of strands of hair is held or confined by the second platform, such as second platform 130, and such that the second part of the group of strands of hair are provided on the first platform, such as first platform 120, where the first part of the group of strands of hair is more toward the roots of the strands of hair than the second part of the group of strands of hair.

More specifically in the case of the applicator member 500, the applicator member 500 can begin in the position illustrated in FIGS. 22 and 25, for instance. The applicator member 500, with the first arm 532 and the second arm 534 in the position illustrated in FIGS. 22 and 25 can be provided to the group of strands of hair such that the second platform 530 is closer to the roots of the group of the strands of hair than is the first platform 520, such that the first part of the group of strands of hair is held or confined by the second platform 530, and such that the second part of the group of strands of hair are provided on the first platform 520. Notably, providing the applicator member 500 to the group of strands of hair may not involve picking up or otherwise grabbing the group of strands of hair by hand. The first arm 532 and the second arm 534 can then be caused to move to the position illustrated in FIGS. 18-20, for instance, by depression of a button at the top of the interface mechanism 600 (see the down-going portion of the arrow of FIG. 23). In this position, the group of strands of hair can still be provided such that such that the first part of the group of strands of hair is held or confined by the second platform 530, and such that the second part of the group of strands of hair are provided on the first platform 520. Incidentally, the bristles 564 can hold the group of strands of hair during the processes of applying the hair care product and/or moving the applicator member 500 toward the ends of the group of strands of hair.

At block 706, the method 700 can comprise outputting hair care product from the applicator member. The hair care product may be output to the portion or portions of hair held, tabled or confined by the applicator member. Though method 700 shows block 706 after block 704, in one or more embodiments the hair care product can be output to the applicator member prior to the applicator member being provided to the area of hair.

At block 708 the applicator member can be moved along the hair, in a direction toward the ends of strands of hair held, tabled or confined by the applicator member. Optionally, hair care product may be output from the applicator member to the strands of hair continuously or intermittently as the applicator member is moved toward the ends of the strands of hair. That is, in one or more embodiments, the hair care product may be output simultaneous with the movement of the applicator member toward the ends of the strands of hair. In the case of the applicator member 100, 200, as the applicator member is moved away from the roots of the group of strands of hair, the group of strands of hair may be held by hand as the applicator member 100, 200 is moved toward the ends of the strands of hair. Also, in the case of the applicator member 500, when the button at the top of the interface mechanism 600 is released, the applicator member 500 can return to the position illustrated in FIGS. 22 and 25 (see the up-going portion of the arrow of FIG. 23) based on the biasing components of the interface mechanism acting on the applicator member 500, particularly the first arm 532 and the second arm 534.

Embodiments of the disclosed subject matter may also be as set forth in the following parentheticals.

(1) An applicator member to provide hair care product comprising: a base defining a discharge opening to discharge the hair care product; a first platform extending from the base adjacent a first side of the discharge opening, the first platform having a free end configured to hold a first amount of hair; and a second platform provided adjacent a second side of the discharge opening opposite the first side, the second platform defining a first cutout configured to hold a second amount of hair greater than the first amount of hair, wherein a first part of the first cutout farthest from the base is wider than a second part of the first cutout closest to the base.

(2) The applicator member of (1), wherein a width of a base portion of the first platform where the first platform extends from the base is less than a width of the first cutout at a height parallel to a height of the free end of the first platform.

(3) The applicator member of either (1) or (2), wherein the first platform has a height, as measured from a top surface of the base, greater than a maximum width of the first platform.

(4) The applicator member of any of (1)-(3), wherein, in a side elevational view of the dispensing applicator member, an acute angle is formed by a first line segment between a first end point of the second part of the first cutout closest to the base at a central vertical axis of the first cutout and a second end point of the first part at one side of the first cutout and a second line segment between the first end point and a third end point of the first part at the other side of the first cutout.

(5) The applicator member of any of (1)-(4), wherein the acute angle has a value from about 15 degrees to about 75 degrees, from about 20 degrees to about 65 degrees, or from about 25 to about 60 degrees.

(6) The applicator member of any of (1)-(5), wherein a height of the first cutout is greater than or equal to a width of the first cutout at the first part.

(7) The applicator member of any of (1)-(6), wherein a ratio of a height of the first cutout and a width at the first part of the first cutout is about 1:1 to about 5:1.

(8) The applicator member of any of (1)-(7), wherein a width of the first cutout at the first part is a value from about 1.5 millimeters to about 15 millimeters or from about 2.5 millimeters to about 12 millimeters.

(9) The applicator member of any of (1)-(8), wherein the second platform has only one cutout, the only one cutout being said first cutout.

(10) The applicator member of any of (1)-(9), wherein, in a side elevational view of the applicator member, a central vertical axis of the first platform is aligned with a central vertical axis of the first cutout of the second platform.

(11) The applicator member of any of (1)-(10), wherein the dispensing applicator member is asymmetrical in a side elevational view thereof orthogonal to a line extending through a central vertical axis of the first platform and a central vertical axis of the first cutout of the second platform.

(12) The applicator member of any of (1)-(11), wherein the first cutout is one of U-shaped or V-shaped.

(13) The applicator member of any of (1)-(12), wherein the second platform extends from the base adjacent the second side of the discharge opening, the second part of the first cutout closest to the base being offset from the base in a direction in which the second platform extends from the base.

(14) The applicator member of any of (1)-(13), wherein the base of the first platform defines a portion of an inner surface of the discharge opening, and the second platform is spaced radially outward from the discharge opening by a distance.

(15) The applicator member of any of (1)-(14), further comprising a nozzle extending from the base adjacent the discharge opening, the first platform forming at least a portion of the nozzle, and the nozzle surrounding the discharge opening in an overhead plan view of the dispensing applicator member.

(16) The applicator member of any of (1)-(15), further comprising a vertical wall extending from the base adjacent the second side of the discharge opening, the vertical wall being between the first platform and the second platform.

(17) The applicator member of any of (1)-(16), wherein the vertical wall defines a second cutout, the second cutout being configured to allow hair care product discharged from the discharge opening of the base to flow toward the second platform.

(18) The applicator member of any of (1)-(17), wherein the first platform and the vertical wall are connected by a first sidewall and a second sidewall extending from the base adjacent on opposite sides of the discharge opening.

(19) The applicator member of any of (1)-(18), wherein a width of a base portion of the first platform where the first platform extends from the base is less than a first width of the first cutout at a height parallel to a height of the free end of the first platform, and wherein a second width of the first cutout below the height parallel to the height of the free end of the first hair holding platform is less than the width of the base portion of the first platform where the first platform extends from the base.

(20) The applicator member of any of (1)-(19), wherein a first surface portion of the base, at one side of the first platform in a width direction of the first platform, is configured to hold a third amount of hair, wherein a second surface portion of the base, at the other side of the first platform in the width direction of the first platform, is configured to hold the third amount of hair, and wherein the third amount of hair is less than the second amount of hair.

(21) The applicator member of any of (1)-(20), further comprising a pair of sidewalls extending from the base to a same height on opposite sides of the first platform, the discharge opening, and the second platform, each of the sidewalls being connected to the second platform and not the first platform, the same height of the pair of sidewalls being greater than a height of the first platform, wherein respective spaces between the sidewalls and the first platform are configured to hold a third amount of hair less than the second amount of hair.

(22) The applicator member of any of (1)-(21), further comprising a pair of sidewalls extending from the base on opposite sides of the first platform and the discharge opening, wherein respective spaces between the sidewalls and the first platform do not overlap the first cutout in a side elevational view of the dispensing applicator member.

(23) The applicator member of any of (1)-(22), further comprising a pair of sidewalls extending from the base on opposite sides of the first platform, each of the sidewalls having a plurality of bristles extending from a first side thereof opposite a second side facing the first platform.

(24) The applicator member of any of (1)-(23), further comprising: a connection interface fixedly or removably coupled to the base; and a container, to contain the hair care product, fixedly or removably coupled to the connection interface, wherein the connection interface forms an acute angle with a central longitudinal axis of the container.

(25) An apparatus comprising: means for receiving and outputting an amount of hair care product; and means for presenting hair to apply the amount of hair care product output by the means for receiving and outputting, wherein the means for presenting hair to apply the amount of hair care product includes: first means for holding a first amount of hair; and second means for holding a second amount of hair, wherein the first means for holding the first amount of hair is separated from the second means for holding the second amount of hair by the means for receiving and outputting the amount of hair care product, and wherein the first amount of hair is less than the second amount of hair.

(26) The apparatus of (25), wherein the second means for holding the second amount of hair has a widest part wider than a widest part of the first means for holding the first amount of hair.

(27) The apparatus of (25) or (26), wherein the first means for holding the first amount of hair has a height greater than a width.

(28) The apparatus of any of (25)-(27), further comprising means for holding a third amount of hair, the third amount of hair being less than the second amount of hair and being partitioned by the first means for holding the first amount of hair.

(29) The apparatus of any of (25)-(28), further comprising means for confining the amount of hair care product output by the means for receiving and outputting.

(30) The apparatus of any of (25)-(29), wherein a bottom portion of the first means for holding the first amount of hair is part of the means for receiving and outputting an amount of hair care product.

(31) The apparatus of any of (25)-(30), wherein the second means for holding the second amount of hair is spaced apart from the means for receiving and outputting the amount of hair care product.

(32) The apparatus of any of (25)-(31), wherein the second means for holding the second amount of hair defines a single opening, a depth of the single opening being greater than a width of the single opening.

(33) The apparatus of any of (25)-(32), wherein the second means for holding the second amount of hair defines an opening, a right triangle being formed by a central vertical axis of the opening, a first line segment from the central vertical axis perpendicular to the a point defining an entrance to the opening, and a second line segment from the point defining the entrance to the opening to a deepest part of the opening at the central vertical axis.

(34) An applicator attachment tip for applying hair dye comprising: a base having a first side and a second side opposite the first side and defining a discharge opening, the first side having an upper surface; a nozzle, which surrounds the discharge opening, extending from the upper surface of the base, the nozzle including a first platform extending from the upper surface of the base; and a second platform extending from the upper surface of the base, the discharge opening being between the first platform and the second platform, the second platform having a wall that defines only one cutout, wherein the second platform is spaced from the discharge opening more than the first platform is spaced from the discharge opening, wherein a first part of the cutout farthest from the upper surface of the first side of the base is wider than a second part of the cutout closest to the upper surface of the first side of the base, wherein a height of the cutout is greater than a width of the cutout at the first part, the width of the cutout at the first part being a value from about 1.5 millimeters to about 15 millimeters or from about 2.5 millimeters to about 12 millimeters, wherein the second part of the cutout closest to the upper surface of the first side of the base is offset from the upper surface of the first side of the base in a direction in which the second platform extends from the upper surface of the first side of the base, and wherein the first platform has a height, as measured from the upper surface of the base, greater than a width.

(35) The applicator attachment tip of (34), further comprising a pair of sidewalls extending from the upper surface of the base on opposite sides of the nozzle and the second platform, the pair of sidewalls being spaced from the nozzle.

(36) The applicator attachment tip of (34) or (35), wherein the nozzle includes a vertical sidewall that defines a slot, the slot being offset from the upper surface of the first side of the base in the direction in which the second platform extends from the upper surface of the first side of the base, and the vertical sidewall being between the first platform and the second platform.

(37) A method of providing an applicator member according to any one of (1)-(24).

(38) A method of providing an apparatus according to any one of (25)-(33).

(39) A method of providing an applicator attachment tip according to any one of (34)-(36).

(40) A method of using an applicator member according to any one of (1)-(24).

(41) A method of using an apparatus according to any one of (25)-(33).

(42) A method of using an applicator attachment tip according to any one of (34)-(36).

(43) A method of using an applicator member for a hair care product comprising: providing the applicator member to apply the hair care product, the applicator member including: a base defining a discharge opening to discharge the hair care product for application, a first platform extending from the base adjacent a first side of the discharge opening, the first platform having a free end configured to hold a first amount of hair, and a second platform provided adjacent a second side of the discharge opening opposite the first side, the second platform defining a cutout configured to hold a second amount of hair greater than the first amount of hair, wherein a first part of the cutout farthest from the base is wider than a second part of the cutout closest to the base; for a group of strands of hair, providing a first part of the group of strands of hair to the second platform, in the cutout of the second platform, the first part of the group of strands of hair corresponding to the second amount of hair; and providing a second part of the group of strands of hair on the first platform, the second part of the group of strands of hair corresponding to the first amount of hair.

(44) The method of (43), further comprising: applying the hair care product to the group of strands of hair, between the first platform and the second platform.

(45) The method of either (43) or (44), further comprising: moving the applicator member along the group of strands of hair toward tips of the strands of hair of the group.

(46) The method of any of (43)-(45), further comprising: outputting the hair care product to an area between the first platform and the second platform.

(47) The method of any of (43)-(46), wherein said outputting the hair care product is with the first part of the group of strands of hair provided in the cutout of the first platform, and with the second part of the group of strands of hair provided on the first platform.

(48) The method of any of (43)-(47), further comprising: providing a third part of the group of strands of hair on the base on a first side of the first platform; and providing a fourth part of the group of strands of hair on the base on a second side of the first platform opposite the first side.

Having now described embodiments of the disclosed subject matter, it should be apparent to those skilled in the art that the foregoing is merely illustrative and not limiting, having been presented by way of example only. Thus, although particular configurations have been discussed and illustrated herein, other configurations can be and are also employed. Further, numerous modifications and other embodiments (e.g., combinations, rearrangements, etc.) are enabled by the present disclosure and are contemplated as falling within the scope of the disclosed subject matter and any equivalents thereto. Features of the disclosed embodiments can be combined, rearranged, omitted, etc., within the scope of described subject matter to produce additional embodiments. Furthermore, certain features may sometimes be used to advantage without a corresponding use of other features. Accordingly, Applicant intends to embrace all such alternatives, modifications, equivalents, and variations that are within the spirit and scope of the present disclosure.

LIST OF ELEMENTS

100 applicator member
110 base
111 discharge opening
111*a* first side of discharge opening
111*b* second side of discharge opening
112 upper surface of base
114 lower side of base
116 connection interface
117 outer wall of connection interface
118 inner wall of connection interface
120 first platform
122 platform base
124 free end of first platform
126 cutout
W4 width of first platform at platform base
H2 height of first platform
W5 width of free end
130 second platform
132 first pylon
134 second pylon
136 bridge portion
138 cutout of second platform
D1 offset distance of bridge portion from upper surface of base
W1 width at top of cutout
H1 height of cutout of second platform
H1' alternative height of cutout of second platform
W2 width of cutout at height of first platform
W3 width of cutout at height of cutout 142
θ angle
CA1 central vertical axis (side elevational view)
H3 height of pylons
140 vertical wall
142 cutout of vertical wall
144 sidewall
146 sidewall
D2 distance from second platform
D3 distance from first pylon to second pylon
DIR direction of application
150 group of strands of hair (second group/amount/portion)
152 subgroup of strands of hair (first group/amount/portion)
154 subgroup of strands of hair (third group/amount/portion)
156 subgroup of strands of hair (fourth group/amount/portion)
200 applicator member
260 outer wall
262 outer wall
264 bristle
265 projection
D4 distance from sidewall to outer wall
300 angled interface
CA2 central vertical axis (of upright portion of angled interface)
400 hair care product container
500 applicator member
510 base
511 discharge opening
511*a* first side of discharge opening
511*b* second side of discharge opening
520 first platform
530 second platform
532 first arm
534 second arm
564 bristle
565 projection
540 vertical wall
544 sidewall
546 sidewall
W6 width of first platform
W7 width of cutout of first platform
600 interface mechanism
650 hair care product container
700 method
702 block

704 block
706 block
708 block

The invention claimed is:

1. An applicator member to provide hair care product comprising:

a base defining a discharge opening to discharge the hair care product;

a first platform extending from the base adjacent to a first side of the discharge opening, the first platform having a free end configured to hold a first amount of hair greater than none;

a second platform provided adjacent to a second side of the discharge opening opposite the first side, the second platform defining a first cutout configured to hold a second amount of hair greater than the first amount of hair; and a nozzle extending from the base adjacent the discharge opening, wherein the first platform forms at least a portion of the nozzle, wherein the nozzle surrounds the discharge opening in an overhead plan view of the applicator member, wherein the first platform and the second platform are diametrically opposite to one another, and wherein a first part of the first cutout farthest from the base is wider than a second part of the first cutout closest to the base.

2. The applicator member of claim 1, wherein a width of a base portion of the first platform where the first platform extends from the base is less than a width of the first cutout at a height parallel to a height of the free end of the first platform.

3. The applicator member of claim 1, wherein the first platform has a height, as measured from a top surface of the base, greater than a maximum width of the first platform.

4. The applicator member of claim 1, wherein a height of the first cutout is greater than or equal to a width of the first cutout at the first part.

5. The applicator member of claim 1, wherein a ratio of a height of the first cutout and a width at the first part of the first cutout is about 1:1 to about 5:1.

6. The applicator member of claim 1, wherein the second platform has only one cutout, the only one cutout being said first cutout.

7. The applicator member of claim 1, wherein, in a side elevational view of the applicator member, a central vertical axis of the first platform is aligned with a central vertical axis of the first cutout of the second platform.

8. The applicator member of claim 1, wherein the first cutout is one of U-shaped or V-shaped.

9. The applicator member of claim 1, wherein the second platform extends from the base adjacent the second side of the discharge opening, the second part of the first cutout closest to the base being offset from the base in a direction in which the second platform extends from the base.

10. The applicator member of claim 1, wherein a base of the first platform defines a portion of an inner surface of the discharge opening, and the second platform is spaced radially outward from the discharge opening by a distance.

11. The applicator member of claim 1, further comprising a vertical wall extending from the base adjacent the second side of the discharge opening, the vertical wall being between the first platform and the second platform.

12. The applicator member of claim 11, wherein the first platform and the vertical wall are connected by a first sidewall and a second sidewall extending from the base adjacent on opposite sides of the discharge opening.

13. The applicator member of claim 1, wherein a first surface portion of the base, at one side of the first platform in a width direction of the first platform, is configured to hold a third amount of hair, wherein a second surface portion of the base, at the other side of the first platform in the width direction of the first platform, is configured to hold the third amount of hair, and wherein the third amount of hair is less than the second amount of hair.

14. The applicator member of claim 1, further comprising a pair of sidewalls extending from the base on opposite sides of the first platform, each of the sidewalls having a plurality of bristles extending from a first side thereof opposite a second side facing the first platform.

15. The applicator member of claim 1, further comprising:

an angled connection interface fixedly or removably coupled to the base; and a container, to contain the hair care product, fixedly or removably coupled to the connection interface, wherein the angled connection interface forms an acute angle with a central longitudinal axis of the container.

16. An apparatus comprising:

means for receiving an amount of hair care product defining a means for outputting the amount of hair care product;

means for presenting hair to apply the amount of hair care product output by the means for outputting; and means for guiding the amount of hair care product extending from the means for receiving adjacent the means for outputting, wherein the means for presenting hair to apply the amount of hair care product includes:

first means for holding a first amount of hair greater than none; and second means for holding a second amount of hair, wherein the first means forms at least a portion of the means for guiding, wherein the means for guiding surrounds the means for outputting in an overhead plane view of the apparatus, wherein the first means for holding the first amount of hair and the second means for holding the second amount of hair are diametrically opposite to one another, wherein the first means for holding the first amount of hair is separated from the second means for holding the second amount of hair by the means for outputting the amount of hair care product, and wherein the first amount of hair that the first means is configured to hold is less than the second amount of hair that the second means is configured to hold.

17. A method of using an applicator member for a hair care product comprising:

providing the applicator member to apply the hair care product, the applicator member including:

a base defining a discharge opening to discharge the hair care product for application, a first platform extending from the base adjacent a first side of the discharge opening, the first platform having a free end configured to hold a first amount of hair, a second platform provided adjacent a second side of the discharge opening opposite the first side, the second platform defining a cutout configured to hold a second amount of hair greater than the first amount of hair, and a nozzle extending from the base adjacent the discharge opening, wherein the first platform forms at least a portion of the nozzle, wherein the nozzle surrounds the discharge opening in an overhead plan view of the dispensing applicator member, wherein the first platform and the second platform are diametrically opposite to one another, and wherein a first part of the cutout farthest from the base is wider than a second part of the cutout closest to the base;

for a group of strands of hair, providing a first part of the group of strands of hair to the second platform, in the cutout of the second platform, the first part of the group of strands of hair corresponding to the second amount of hair; and providing a second part of the group of strands of hair on the first platform, the second part of the group of strands of hair corresponding to the first amount of hair.

18. The method of claim 17, further comprising:

applying the hair care product to the group of strands of hair, between the first platform and the second platform.

19. The method of claim 17, further comprising:

moving the applicator member along the group of strands of hair toward tips of the strands of hair of the group.

* * * * *